US005123147A

United States Patent [19]

Blair

[11] Patent Number: 5,123,147

[45] Date of Patent: Jun. 23, 1992

[54] RESTRAINT HARNESS BUCKLE ASSEMBLY AND METHOD OF MAKING

[75] Inventor: Terry J. Blair, Silverado, Calif.

[73] Assignee: Pacific Scientific Company, Newport Beach, Calif.

[21] Appl. No.: 585,496

[22] Filed: Sep. 20, 1990

[51] Int. Cl.[5] ..... A44B 11/25

[52] U.S. Cl. ..... 24/636; 24/633; 24/637

[58] Field of Search ..... 24/636, 633, 637, 638, 24/646, 647, 650

[56] References Cited

U.S. PATENT DOCUMENTS

| | | | |
|---|---|---|---|
| 416,985 | 12/1889 | Beattie . | |
| 885,064 | 4/1908 | Luhmann . | |
| 950,434 | 2/1910 | Carlson . | |
| 2,896,284 | 7/1959 | Bishaf . | |
| 2,965,942 | 12/1960 | Carter . | |
| 3,110,071 | 11/1963 | Higuchi . | |
| 3,118,208 | 1/1964 | Wexler . | |
| 3,144,696 | 8/1964 | Carter et al. . | |
| 3,343,229 | 9/1967 | Tanaka | 24/637 X |
| 3,358,340 | 12/1967 | Higuchi . | |
| 3,423,799 | 1/1969 | Higuchi . | |
| 3,494,007 | 2/1970 | Dahms | 24/637 |
| 3,566,955 | 3/1971 | Kuszynski | 24/633 |
| 3,605,209 | 2/1970 | Alarcon | 24/637 |
| 3,760,464 | 9/1973 | Higuchi . | |
| 3,872,550 | 3/1975 | Yang . | |
| 4,692,857 | 2/1987 | Ono | 24/637 |
| 4,766,654 | 8/1988 | Sugimoto | 24/637 |
| 4,876,770 | 10/1989 | Bougher . | |

FOREIGN PATENT DOCUMENTS 1377155 9/1964 France .

*Primary Examiner*—Laurie K. Cranmer

*Attorney, Agent, or Firm*—Knobbe, Martens, Olson & Bear

[57] ABSTRACT

A cover which fits over a restrain harness buckle assembly. The cover slides down over the buckle and confines the ends of cam support pins in the assembly, eliminating the need for the use of pins with heads on one end, for fasteners to hold such pins in place, and the need for machining threads or grooves on the pins to cooperate with such fasteners. Additionally, the cover provides a smooth, contoured appearance which insures that nothing protrudes from the buckle assembly which might snag clothing or scratch skin. Thus, the cover eliminates the need for extra parts, machining, and assembly while providing a neater appearance.

19 Claims, 3 Drawing Sheets

RESTRAINT HARNESS BUCKLE ASSEMBLY AND METHOD OF MAKING

FIELD OF THE INVENTION

The present invention relates to restraint harnesses and more particularly to an improved buckle assembly for a seat belt and to a method of making it.

DESCRIPTION OF THE PRIOR ART

One well-known seat belt buckle assembly includes a U-shaped base having upstanding sidewalls that supports a pin carrying a locking cam, a spring and a handle. Lifting one end of the handle will rotate the locking cam against the force of the spring. A clasp or plate on one end of a belt, inserted between the base sidewalls, is clamped to a protrusion on the base by the spring loaded cam, when the handle is released. The protrusion from the base generally absorbs any force which would disunite the coupled clasp. The clasp can be released from the protrusion by again lifting the handle to rotate the locking cam away from the across the base sidewalls, holds a webbing adjustor cam for the other end of the belt or webbing.

Generally, the two pins through the base of the buckle protrude slightly beyond the sidewalls of the buckle. They traditionally have a head on one end and are held by a threaded nut or a snap retaining washer on the other end. Alternatively, one or both ends are deformed, after the pin is installed, and thereby held in place. The use of extra components and the installation process add to the cost of the unit. They also make disassembly for repair purposes difficult and time consuming. Further adding to the cost, it is necessary to make the outside of each sidewall and the pin ends and fasteners generally smooth, to prevent a scratching hazard for clothing and skin. Additionally, the appearance of such exposed, protruding components is unattractive. Thus, a need exists for an improved buckle structure and assembly technique.

SUMMARY OF THE INVENTION

The present invention employs a cover which fits over a restraint harness buckle assembly of the general type discussed above. The cover insures that nothing protrudes from the buckle that presents a scratching hazard and, additionally, improves the appearance of the unit. The cover confines the ends of cam support pins in the assembly and eliminates the need for the use of pins with heads on one end and for fasteners to hold the pins in place. Additionally, the cover eliminates the need for machining threads or grooves on the pins to cooperate with such fasteners. The cover is made of slightly deformable yet highly resilient plastic. The pins protrude through the sidewalls of a support body and slide into recesses on the inside of the cover. The cover sidewalls snap over the pin ends to lock them in place. This eliminates the need for extra parts and assembly while providing a neater appearance.

DESCRIPTION OF THE PREFERRED EMBODIMENT

Figure 1:
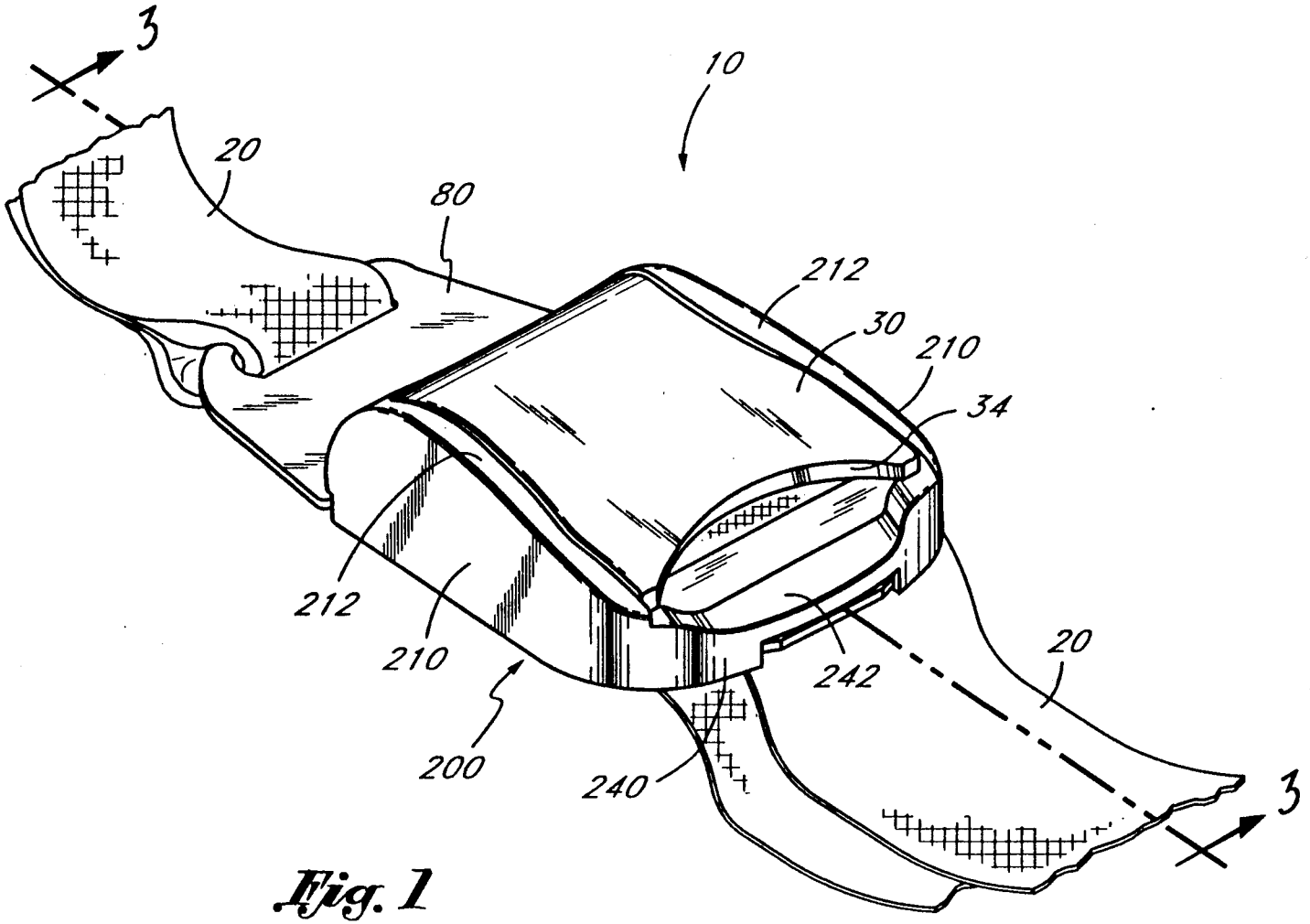
FIG. 1 is a perspective view of the restraint harness buckle assembly of the invention with its improved cover.

In FIG. 1, a restraint harness buckle apparatus 10 is shown with webbing sections 20 attached. The webbing sections 20 extend and are connected securely at the other end to a support of the automobile, airplane, or other vehicle in which the restraint harness is mounted. The buckle 10 could also be employed as a traditional belt buckle, connecting a continuous belt around the user. The restraint harness is meant to fit around the waist area or over the shoulder of the user as is typical in automobiles. The buckle 10 is meant to reside in front of the user with its handle 30 facing outwardly.

Figure 2:
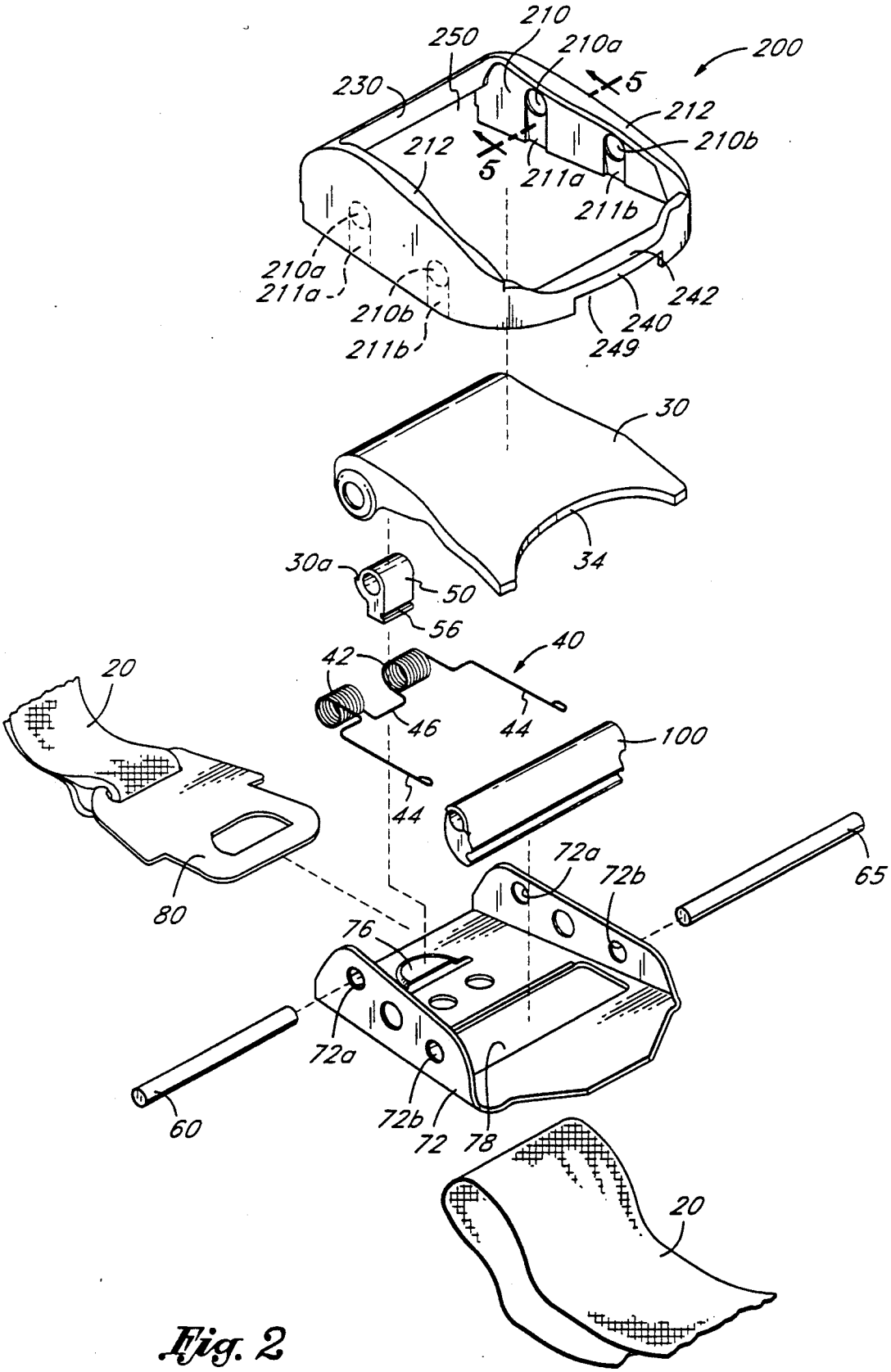
FIG. 2 is an exploded perspective view of the assembly of FIG. 1.
Figure 4:
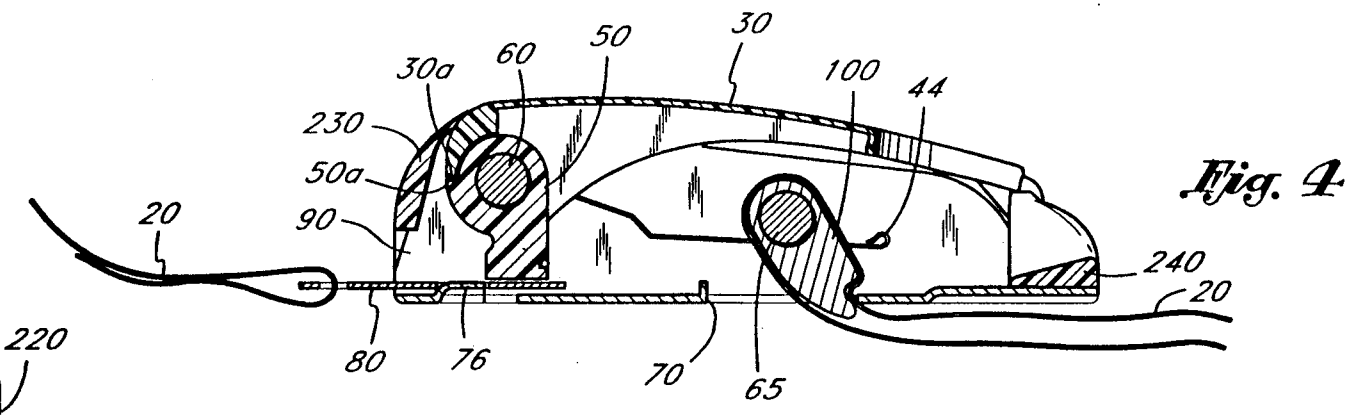
FIG. 4 is a cross-section along the line 3—3 of FIG. 1 of the buckle apparatus with the handle in the locked position.
Figure 3:
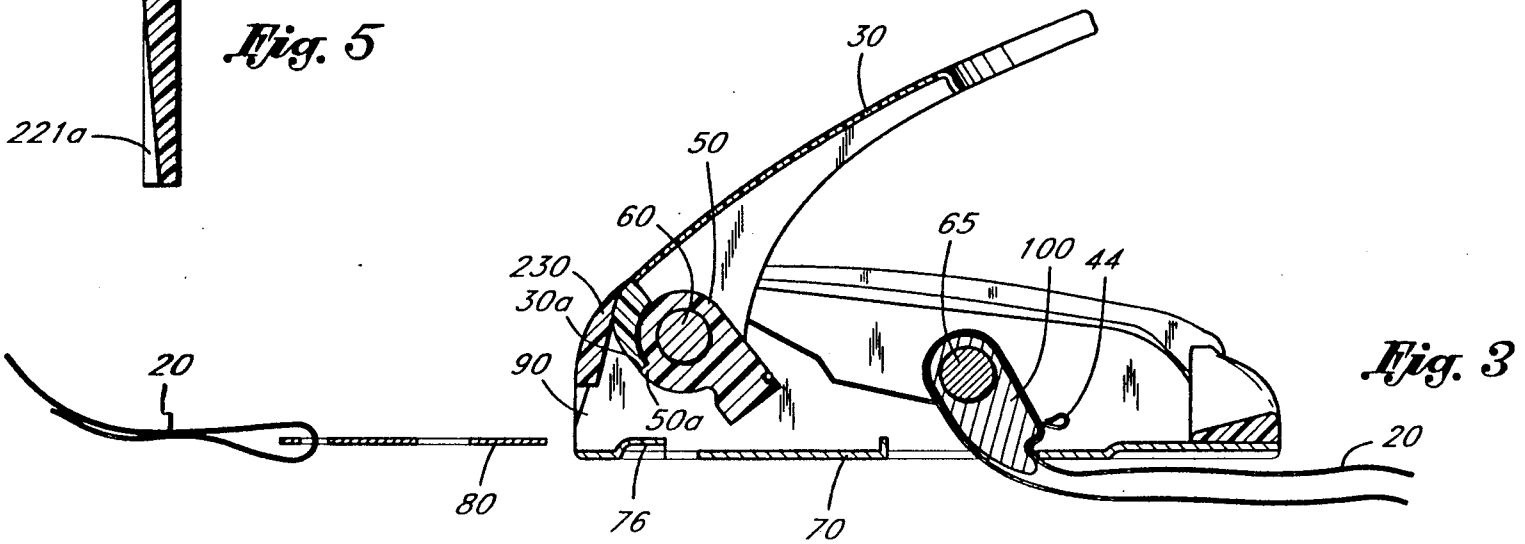
FIG. 3 is a cross-section along the line 3—3 of FIG. 1 of the buckle apparatus with the handle in the open position.

FIG. 2 is an exploded view of the buckle apparatus. The handle 30, a metal spring 40, and a locking cam 50 are mounted on a metal latch pin 60. A metal support or base 70 has a generally U-shaped cross section, including a bottom wall 71 and upwardly extending sidewalls 72 through which the pin 60 protrudes on either side at holes **72*a* in the forward area of the base sidewalls 72. The locking cam 50 rests above a protrusion 76 from the base bottom wall 71. The spring 40 is loaded such that ends 44 of the coils are wedged near each sidewall underneath another pin 65 which is supported by the base sidewalls 72, thereby anchoring the spring to the base of the restraint harness buckle 10. A straight spring section 46 between the two spring coils 42 engages a groove 56 at the bottom of the locking cam. As shown in FIGS. 3 and 4, the handle includes a transversely elongated shoulder 30*a* which engages a mating shoulder 50*a* on the locking cam 50. Thus, any lifting force applied to the handle 30 rotates the locking cam 50 against the restoring force of the spring 40 such that the locking cam 50 moves away from the protrusion 76, as shown in FIG. 3**.

With the locking cam 50 rotated away from the protrusion 76, a female clasp 80 can be inserted into a mouth 90 at the front of the buckle 10, over the protrusion 76, coupling the two together. When the handle 30 is released, the spring 40 returns the locking cam 50 and the handle 30 to their rest positions, locking the female clasp 80 in place over the protrusion 76, as shown in FIG. 4. Alternatively, the female clasp 80 can be inserted into the mouth 90 at the front of the buckle 10 and forcibly pressed against the locking cam 50 with enough force to overcome the restoring force of the spring 40, rotating the locking cam 50 away form the protrusion 76. The spring 40 has enough restoring force that it holds the handle 30 and the locking cam 50 in the closed position unless manual force is applied to the handle 30 or the locking cam 50. In this way the female clasp 80 is locked to the protrusion 76 to restrain the occupant of the vehicle.

A second aligned pair of holes **72*b* extend through the base sidewalls 72 rearwardly of the holes 72*a*. A webbing adjustor cam 100 is mounted on a pin 65 extending through the holes 72*b* with the pin 65 ends protruding slightly beyond the base sidewall 72. The webbing 20 is threaded through a slot 78 in the base bottom wall 71, looped over the adjustor cam 100 and threaded back through the slot 78. By rotating the webbing adjustor cam 100, the webbing length can be adjusted and frictionally locked in place against the rear edge of the slot 78**. Thus, the restraint harness adjusts to fit a variety of people.

A cover 200, made of slightly deformable yet highly resilient molded plastic, frames the base 70. This cover or frame 200 comprises two spaced sidewalls 210, a front wall 230 and a rear wall 240. Each sidewall 210 has a small lip 212 extending inwardly at its upper edge. There are shallow circular recesses 210*a* and 210*b* in the inner surface of each cover sidewall 210. The recesses 210*a* are arranged forwardly of the recesses 210*b* at a distance approximately equal to the distance between the holes 72*a* and 72*b* of the base 70. The recesses in one wall are respectively aligned with the recesses of the other wall. Recesses 210*a* are intended to receive the ends of the pin 60, and the recesses 210*b* are intended to receive the ends of the pin 65. Each recess 210*a* is led to by a channel 211*a* and each recess 210*b* is led to by a channel 211*b* to facilitate installation of the cover 200 onto the base 70 over the protruding pins 60, 65.

Figure 5:
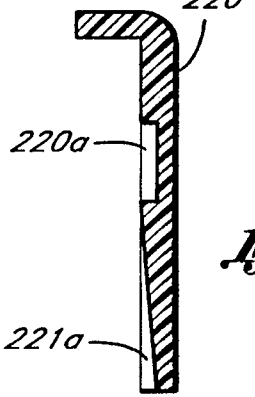
FIG. 5 is a cross-sectional view of the cover on line 5—5 of FIG. 2.

The channel 211*a*, shown in cross section in FIG. 5, is sloped, as are each of the other channels. The slope is determined such that the initial entrance of the pin 60 is easily allowed, yet after the pin 60 is installed in the recess 210*a*, it cannot inadvertently escape. For easy initial insertion of the pin 60, the distance between the entrance to the channels 211*a* in each sidewall 210 is about equal to the length of the pin 60. The channels 211*a* then slope inwardly towards each other, narrowing the span between the bottom of the channels 211*a* into which the pin 60 must fit. The channels 211*a* slope inwardly to where they intersect the recesses 210*a*. The depth of the recess 210*a* is about equal to that of the entrance to the channel 211*a*. Thus, the length between the bottom of the recesses 210*a* is about equal to the length of the pin 60. Similarly, the second set of sloped channels 211*b* and recesses 210*b* are molded at the rear of each cover sidewall 210 to receive the webbing adjustor cam pin 65.

In assembly, the pin 60 is placed at the entrance to the channels 211*a*, and the pin 65 is at the entrance to the channels 211*b*. The cover 200 is slid downwardly over the base 70 such that the base sidewalls 72 rest directly inside the cover sidewalls 210. The distance between the inner edge of the cover sidewalls 210 is slightly greater than the distance between the outer edge of the base sidewalls 72 yet less than the length of the pins 60 and 65 that protrude slightly through each base sidewall 72. The slightly deformable cover 200 expands due to the pressure of the pins 60 and 65 and against the channels 211*a* and 211*b*, further helping the movement of the pins toward their respective set of recessed holes 210*a* and 210*b*. At the end of the channels 211*a* and 211*b*, the pins 60 and 65 pop into their respective set of recesses 210*a* and 210*b*. When the pins pop into the recesses, the slightly deformable yet highly resilient cover 200 returns to its original shape. Thus, the pins cannot inadvertently escape the recesses in which they rest.

Thus, the cover 200 is forcibly slid over both pins 60 and 65 such that each end of each pin 60 and 65 is captured by its respective recess 210*a* and 210*b*. In this fashion, the cover 200 captures the pins while at the same time the pins capture the cover 200 on the buckle assembly 10.

The cover 200 is thus installed over the base such that the cover sidewalls 210 straddle and cover the base sidewalls 72. The rear wall 240 of the cover is notched at 249 to accept a flange 79 at the rear of the base 70 such that the bottom edge of the cover and the bottom of the base 70 are aligned. The front wall 230 covers the front edge of the base sidewalls 72 and, additionally, forms the upper edge of the mouth 90 intended to receive the female clasp 80. The handle 30 now rests at the top of the cover 200 in the open center area 250. It overlays the base 70, covering the internal parts, including the spring 40, locking cam 50 and adjustor cam 100. The lips 212, extending inwardly from the top of each cover sidewall 210, cover the top edge of each base sidewall 72 and align with the edges of the handle 30, thus creating a smooth appearance on the top of the buckle assembly 10. The lips 212 curve downwardly at the front edge of the cover 200 to meet the front wall 230. This creates a smooth, contoured edge that prevents the buckle from scratching skin or clothing. Additionally, the handle 30 curves at its front edge, extending the downward curve of the lips 212 across the width of the front of the buckle 10. The top edge of the front wall 230 aligns with the front of the handle 30 such that it completes the downward curve at the front of the buckle 10, creating a smooth, contoured appearance at the front of the buckle assembly 10. The rear wall 240 of the cover is scooped 242 to allow easy access to the handle. In addition, the handle has a moon shaped contour 34 curving inwardly at the rear edge, near the scooped area 242 of the cover, to further ease access. Thus, the handle 30 and cover 200 are arranged relative to one another to provide an attractive encasement which substantially encloses the top and sides of the base 70.

The cover 200 replaces the need for retaining snap washers, threaded nuts, heads on the pins, or extra deformation of the pin ends to hold the pins in place. The cover 200 encloses all of the internal parts of the restraint harness buckle assembly by securing the pins in the cover recesses 210*a* and 210*b*. The cover 200 also protects the operator from scratches and clothing snags due to exposed, protruding parts.

One skilled in the art will realize that the cover 200 can be used with many different types of buckles of many different shapes and sizes. Additionally, one skilled in the art will realize that the cover may receive any number of pins given that it contains a corresponding number of recesses.

What is claimed is:

1. A buckle assembly, comprising:

a support having a pair of spaced, upstanding sidewalls;

a pin extending between said sidewalls, said pin having an end extending through and protruding slightly beyond one of said sidewalls; and a cover which fits over said support and is fastened thereto by said pin end, said cover having a wall which encloses said pin end and captures the pin on the support, said pin end being sized to pass freely through said one sidewall upon removal of said cover.

2. The assembly of claim 1, wherein said cover has a recess facing inwardly toward said support for capturing said pin end.

3. The assembly of claim 2, wherein said cover is open on its lower end and has an inwardly facing channel open to said lower end and extending to said recess to guide the pin end and recess together when the cover is placed over said support.

4. The assembly of claim 1, wherein said cover has a frame-like shape including a pair of spaced sidewalls that fit onto said support sidewalls, each of the cover sidewalls having an inwardly facing recess for receiving the ends of said pin, the cover being constructed such that it can be pressed onto the support, into a position where the ends of the pin are captured in said recesses and the cover is correspondingly captured on the pins.

5. The assembly of claim 4, wherein said cover has an open end which fits over said support and each of said cover sidewalls has a sloping channel open to said open end and intersecting with a respective one of said recesses so that the pin ends may slide in said channels to each recess when the cover is snapped onto said pin.

6. The assembly of claim 1, wherein said cover flexes outwardly to permit it to fit over said pin end.

7. A restraint harness buckle assembly, comprising:

a support having a bottom wall and a pair of spaced, upstanding sidewalls;

a latch pin extending between said sidewalls, with the ends of the pin extending through and protruding slightly beyond the sidewalls;

a rotatable cam mounted on said pin, adapted to cooperate with a clasp plate attached to a belt webbing to latch the clasp plate to the buckle assembly; and a cover which fits over said support, said cover having a plurality of walls forming a frame and including a pair of spaced sidewalls that straddle the support sidewalls, a recess facing inwardly toward said support in each cover sidewall, the distance between said recesses being about the length of said pin, said recesses being located in position to receive the ends of said pin when the cover is fully installed on said support, portions of said cover sidewalls leading to said recesses being spaced a dimension less than the length of said pin such that the cover sidewalls must be flexed outwardly to enable the cover to be pressed onto the frame so that the pin ends are received within said recesses, said cover being sufficiently flexible that it will permit the cover sidewalls to be flexed to receive said pin ends and will snap back when the pin reaches said recesses, thereby capturing the pin in the recesses and capturing the cover on the support.

8. The assembly of claim 6, further including a spring urging said rotatable cam into a latched position to lock the belt clasp plate to the buckle apparatus, and a pivotable handle lever urged into said latched position being mounted on said pin wherein the handle lever extends between said support sidewalls, generally parallel to said bottom wall, said handle lever being manually pivotable against the urging of said spring to release said cam from locking said clasp plate to said buckle apparatus, said cam being rotatable separately from said lever handle when said belt clasp plate is inserted between said cam and the bottom wall of said support.

9. The assembly of claim 8, wherein said support bottom wall includes an upwardly extending projection which is adapted to receive a hole in said belt clasp plate when the belt clasp plate is inserted between the cam and the support bottom wall, with the cam in combination with said spring urging the belt latch plate into engagement with said support projection.

10. The assembly of claim 8, wherein said cover includes a forward wall and a rear wall spaced from the forward wall, the forward wall and rear wall being formed integral with said sidewalls, said cover being open on its lower side to fit over said support, and said cover being substantially open on top but extending over the upper edges of said support sidewalls, said upper portions being spaced from each other sufficiently to permit said handle lever to pivot in the space between said upper extending portions.

11. The assembly of claim 10, wherein said handle lever and said cover substantially enclose the top and sides of said support.

12. The assembly of claim 10, wherein said cover forward wall is spaced upwardly from said support bottom wall to define a mouth in combination with said support bottom wall for receiving said belt clasp plate.

13. The assembly of claim 8, wherein a free edge of said handle lever is spaced slightly from the corresponding wall of said cover to enable a person's fingers to engage the free edge of said handle lever to conveniently lift the handle lever and pivot the lever into the unlatched position.

14. The assembly of claim 8, wherein the top surface of said handle lever in its latched position is flush with the upper portions of said cover as well as the rear wall of said cover to form substantially a smooth, continuous enclosure for the top and sides of said assembly.

15. The assembly of claim 6, wherein said cover can flex sufficiently to enable the cover to be snapped onto said support but which will return to its original shape so as to prevent inadvertent removal of the cover from the support.

16. The assembly of claim 6, including a webbing anchor pin extending between said support sidewalls with the ends of the webbing anchor pin extending through and protruding beyond the support sidewalls, said cover sidewalls including a pair of recesses positioned to receive the ends of said webbing anchor pin to capture the webbing anchor pin within said support.

17. The assembly of claim 16, including a webbing adjustor cam mounted on said webbing anchor pin, and an opening in said support bottom wall through which webbing may be inserted and extended around said cam and directed back through said opening in the bottom wall, said webbing adjustor cam being urged against the edge of said opening to frictionally hold said webbing at a desired length.

18. A method of assembling a buckle assembly, comprising:

positioning a handle between sidewalls of a support;

sliding a pin through said handle in and through the sidewalls of the support with an end of the pin protruding beyond the sidewalls; and positioning a cover over said support and capturing the pin end in a recess in the inner surface of said cover such that said pin is kept from sliding out of said support and said cover is retained on said support.

19. The method of claim 18, including mounting said pin on said support so that one end of the pin is captured in a recess in one sidewall of the cover and the other end of the pin is captured in a recess in an opposite sidewall of said cover, said positioning step including pressing the cover onto the support to spread the cover sidewalls slightly by said pin ends to enable the cover to be slid to a position where the pin ends pop into said recesses.

* * * * *